US005090684A

United States Patent [19]

Godi

[11] Patent Number: 5,090,684

[45] Date of Patent: Feb. 25, 1992

[54] GUIDE FOR A SHEET ALIGNING STATION OF A PACKAGE PRODUCING MACHINE

[75] Inventor: Claude A. Godi, Cheseaux, Switzerland

[73] Assignee: Bobst SA, Lausanne, Switzerland

[21] Appl. No.: 687,240

[22] Filed: Apr. 18, 1991

[30] Foreign Application Priority Data

Apr. 19, 1990 [CH] Switzerland ..... 01326/90

[51] Int. Cl.[5] ..... B65H 9/10

[52] U.S. Cl. ..... 271/233; 271/271; 198/457

[58] Field of Search ..... 271/224, 233, 271; 198/457

[56] References Cited

U.S. PATENT DOCUMENTS 2,236,747 4/1941 Cameron .
4,637,524 1/1987 Klancnik et al. ..... 221/239
4,905,981 3/1990 Reist ..... 271/271

FOREIGN PATENT DOCUMENTS 517295 4/1930 Fed. Rep. of Germany .
2460103 6/1976 Fed. Rep. of Germany .
3316518 11/1984 Fed. Rep. of Germany .
3447703 7/1986 Fed. Rep. of Germany .
2448975 9/1980 France .

*Primary Examiner*—Robert P. Olszewski
*Assistant Examiner*—Steven M. Reiss
*Attorney, Agent, or Firm*—Hill, Van Santen, Steadman & Simpson

[57] ABSTRACT

A guide for a sheet aligning station for lateral positioning of a sheet includes a supporting surface mounted on a belt to support the trailing edge of a sheet and a roller extending slightly beyond the supporting surface to contact the sheet edge and reduce friction between the guide and the sheet during crosswise shifting of the sheet, for example by a lateral guiding ruler.

8 Claims, 1 Drawing Sheet

GUIDE FOR A SHEET ALIGNING STATION OF A PACKAGE PRODUCING MACHINE

BACKGROUND OF THE INVENTION

1. Field of the Invention

The present invention relates generally to an aligning station such as in a package producing machine and, more particularly, to an assembly for positioning sheet like workpieces using guides.

2. Description of the Related Art

During the production of packages from, for instance, corrugated board, sheets of corrugated board are taken from a pile and carried individually into subsequent processing stations for cutting and/or shaping, for example.

Transportation of the various successive sheets from the pile to the processing station is achieved by pushing the sheet by means of two movable guides which act as stops for the rear, or trailing, edge of the sheets, these rear guides being fitted onto an endless toothed belt. However, due to the difficulty of centering sheet pile along a lengthwise central axis of the machine, the sheets, while moving from the pile to the processing station, travel through a so-called aligning or lateral guiding station. The aligning station performs a crosswise positioning, in other words perpendicular to the direction of travel, of the various successive sheets so that the sheets are in a desired position relative to the tools of the subsequent processing station. To achieve this perpendicular positioning, the aligning station includes a reference or guiding ruler on one lateral side along which the corresponding side edge of the moving sheet is to be guided. The guiding ruler includes a guiding surface parallel to the motion of the sheet, in other words parallel to the lengthwise axis of the machine, and can be positioned crosswise. The crosswise shift of the sheet, until it touches the guiding ruler is generally obtained by means of so-called oblique rollers which are in contact with the upper side of the sheet and running either freely or are power driven with a peripheral rotary speed which includes a crosswise motion component.

Up to now, every rear guide that contacts the sheet edge has a smooth contact surface perpendicular to the direction of sheet motion. Experience has shown that when the guide driven by the belt is in contact with the cardboard, friction occurs at the contact points, which results in the following drawbacks:

A slight crosswise shift of the belt occurs during lateral shifting of the sheet so that one lateral edge of the belt rubs rather strongly against a corresponding lateral guiding device, resulting in friction which quickly wears out the belt and necessitating its change, particularly at high belt running speeds of, for example, 300 m per minute.

Sheet displacement occurs due to the fact that the crosswise shifting of the sheet may be of a distance of up to 15 mm, so that the combined action of the friction forces acting on the rear guide and on the oblique rollers results in a type of swivel action which obviously would be harmful to subsequent operations since it obstructs proper lateral guidance

SUMMARY OF THE INVENTION

The present invention provides a guiding station involving none of the aforementioned drawbacks and, in particular, provides rear guides which insure a proper lengthwise guiding or positioning of the sheet without simultaneous interference by forces encountered during lateral guiding of the sheet.

This and other objects and advantages of the invention are attained by a guiding station including a guide mounted on an endless belt, the guide having a supporting surface positioned to contact a trailing edge of a sheet to push and position the sheet along the lengthwise axis of the processing machine, means for moving the sheet perpendicularly to the machine axis to provide lengthwise alignment, a ruler or similar sideways aligning guide, and at least one roller having a rotary axis lying essentially perpendicular to the sheet, the roller being mounted so that a small portion of the roller extends before the supporting surface so as to act as a guide for the trailing edge of the sheet.

The objects and advantages are also achieved by a rear guide for an aligning station in a package producing machine having a surface to contact a trailing edge of a sheet to push and position the sheet along the lengthwise axis of a processing machine and a roller having a small periphery portion extending before the supporting surface to act as a stop for the trailing edge of the sheet.

Further characteristics and advantages of the invention will become apparent from a description of an example of an apparatus according to the invention, with reference being made to the attached drawings.

DETAILED DESCRIPTION OF THE PREFERRED EMBODIMENTS

Figure 1:
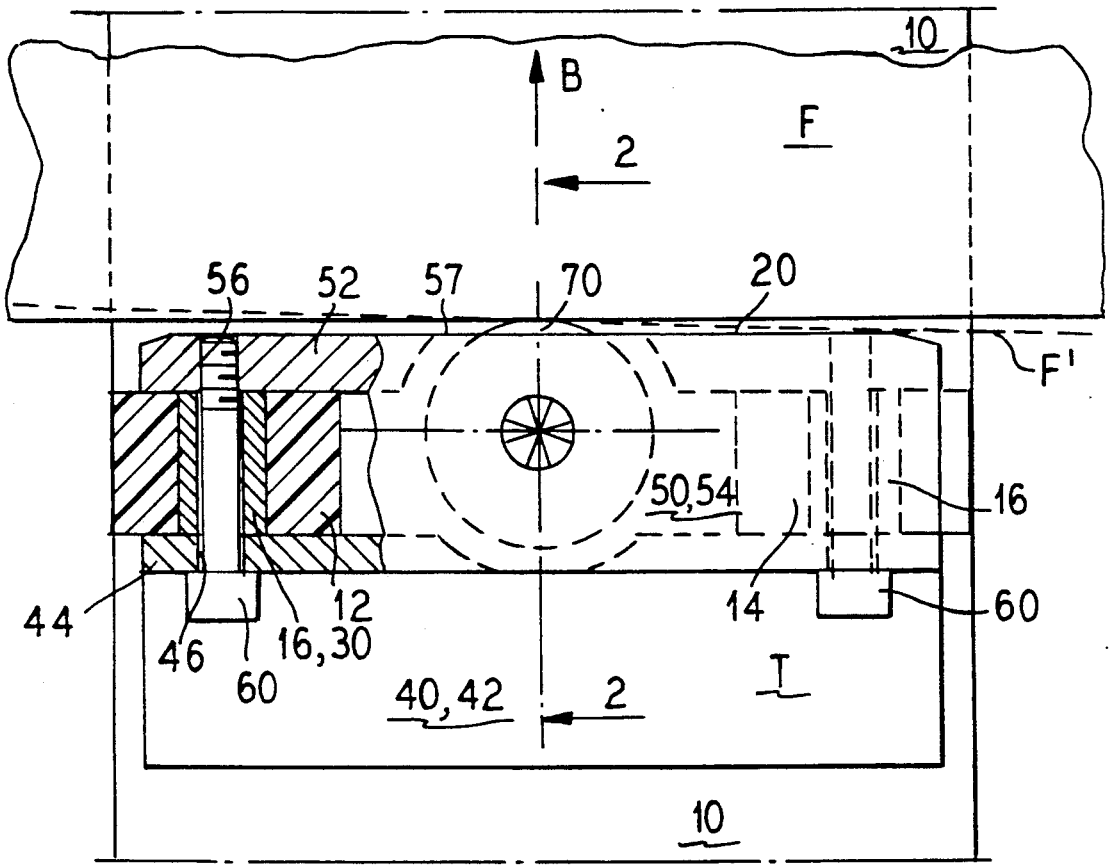
FIG. 1 is a partial sectional top view of a belt provided with a rear guide for use in a guide-type aligning station.

A guide-type aligning station, such as for use in a package producing machine includes, according to the state of the art, at least two belts 10 lying parallel to one another, each of which is a closed loop. The belt 10, which is preferrably a toothed belt, carries at regular intervals guides T, only one of which is shown in FIG. 1. Each of the guides T has a surface 20 destined to act as a support for the rear, or trailing, edge of a sheet F. The belt 10 is driven in a way known in the art and synchronisly with other movements of the machine so that the rear guide T is able to achieve positioning of the sheet F moving in a direction B of the machine axis.

Every rear guide T includes two parallelepipedic blocks 12 and 14 of identical shape. The block 12 and 14 are arranged crosswise at regular intervals on the belt 10. Both blocks 12 and 14 are formed of polyurethane and are vulcanized onto a surface of the belt 10 opposite to and along a tooth 24 of the toothed belt 10. Every block 12 and 14 is provided with a bore 16 extending parallel to the belt 10 and into which a metal bushing 30 is inserted. The metal bushing 30 is of a length which is slightly less than that of the corresponding bore 16.

The guide T also includes a first metal square 50 of which a first leg 52 is provided with a supporting surface 20 which is in contact with the front, or leading, side of each block 12 and 14. The first square 50 also includes a second leg 54 which is in contact with an upper side of the blocks 12 and 14. The guide T also includes a second metal square 40 having a first leg 42 which is in contact with the belt 10 and a second leg 44 in contact with the side of the two blocks 12 and 14 which lies opposite the supporting surface 20. The height of the second leg 44 is slightly less than the height of either of the blocks 12 and 14. The two squares 40 and 50 extend over the entire width of the belt 10 and are provided with holes 46 which are threaded at 56 so as to provide the possibility of clamping the two squares 40 and 50 onto the two blocks 12 and 14 with the assistance of two screws 60 which pass through the holes 46 and into the bushings 16. The screw ends are engaged in the threads 56. Attention is drawn to the fact that the leg 42 of the second square 40 extends over a relatively large surface of the belt to counteract the forces originating from the tilting of the guide caused by the action of the sheet F on the supporting surface 20.

The upper leg 54 of the first square is provided in its center area with an orifice or aperture 58 perpendicular to the belt 10. An axle 72 of a free roller 70 is riveted in the orifice. The dimensions and arrangements of the two blocks 12 and 14 and of the two squares 40 and 50 permit the roller 70 to occupy a space between the belt 10 and the upper leg 54 of the second square 50 and between the two blocks 12 and 14. The leg 52 of the second square 50 is provided with an aperture 57 through which extends a slight peripheral portion of the roller 70. Preferably, the outer periphery of the roller 70 extends approximately 1 mm beyond the supporting surface 20.

Figure 2:
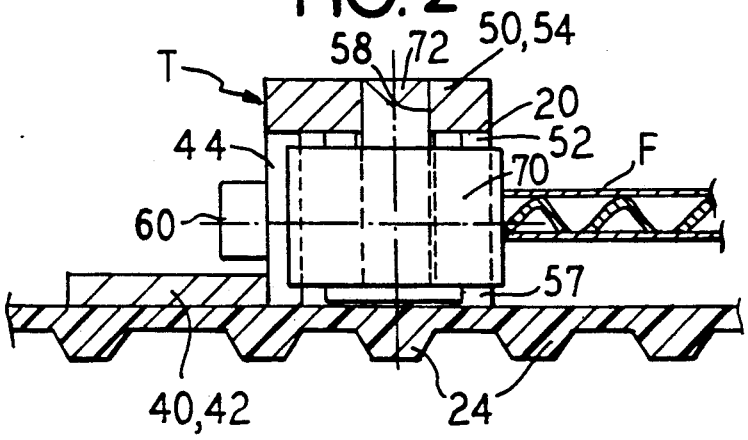
FIG. 2 is a section view generally along line 2—2 of FIG. 1.

As can be seen in FIGS. 1 and 2, the roller 70 eliminates, or at least greatly reduces, frictional forces between the guide T and the sheet F during crosswise shifting of the sheet F in a direction perpendicular to the processing direction B. Moreover and surprisingly, even if the supporting surface 20 is not perfectly perpendicular to the trailing edge of the sheet F, as indicated by the dashed line F' in FIG. 1, the roller 70 will still exert its full force on the trailing edge of the sheet with full efficiency.

On the other hand, experience has revealed that even if the roller 70, on account of its slight penetration into the trailing edge of the sheet F due to the relatively smaller supporting surface, still brings about an uncertainty or an inaccuracy in the guiding and positioning of the sheet in line with the machine axis, the inaccuracy will still be compensated to a considerable extent by the ease and safety which the roller 70 contributes to the crosswise shifting of the sheet for lateral alignment.

Of course, numerous modifications may be added to the invention as described above without going beyond the limits of the invention. For example, screws or rivets may be used for fastening the two blocks 12 and 14 onto the belt 10. Endless chains may be used instead of the belt 10, etc.

Thus, there is disclosed a guide-type sheet aligning station for a package producing machine which includes an aligning guide fitted onto a belt to support the trailing edge of a sheet during lateral adjustment of the sheet position. A supporting surface which abuts the trailing edge of the sheet includes a roller which slightly precedes the supporting surface to reduce friction between the guide and the sheet during the lateral adjustment of the sheet position, for example by a lateral guiding ruler.

Although other modifications and changes may be suggested by those skilled in the art, it is the intention of the inventor to embody within the patent warranted hereon all changes and modifications as reasonably and properly come within the scope of his contribution to the art.

I claim:

1. A sheet aligning device in a package producing machine for successively moving sheets toward a processing station having a drive, comprising:

a movable endless belt driven by the drive to move a sheet in a processing direction along an axis of said package producing machine;

at least one guide mounted on said movable endless belt, said at least one guide having a supporting surface directed to push a trailing edge of the sheet in the processing direction of the machine;

means for moving the sheet perpendicular to the processing direction;

an alignment means for aligning the sheet in a sideways direction relative to the axis of the machine in conjunction with said means for moving; and at least one roller mounted at said at least one guide, said at least one roller being rotatable about a rotary axis extending substantially perpendicular to the sheet, a portion of said roller extending beyond said supporting surface to act as a guide for the trailing edge of the sheet.

2. A sheet aligning device as claimed in claim 1, wherein said at least one guide includes:

a block mounted on said belt:

a square fastened on said block crosswise to a moving direction of said belt, said first square including two legs, a first of said two legs extending perpendicular to a surface of said belt and a second of said two legs extending generally parallel to the surface of said belt, said second leg defining an opening and said first leg defining an aperture; and an axle mounted in said opening of said second leg of said square, said axle rotatably supporting said roller so that a portion of said roller extends through said aperture in said first leg.

3. A sheet aligning device as claimed in claim 2, wherein said square is a first square, and further comprising:

a second square fastened to said block in a direction generally perpendicular to the direction of travel of said belt, said second square including two legs, a first of said two legs being in contact with a side of said block and a second of said two legs being in contact with said belt.

4. A sheet aligning device as claimed in claim 3, wherein said block comprises two blocks mounted generally on either side of said belt, said roller being mounted between said two blocks;

fastening means for fastening said first and second squares onto said two blocks so that said first and second squares are pressed against one another and are pressed against corresponding sides of said two blocks.

5. A sheet aligning device as claimed in claim 4, wherein said fastening means comprises threaded screws, said two blocks each define a hole, and a metal bushing mounted in said hole of each of said two blocks, said metal bushing having a threaded interior bore into which said threaded screws are inserted

6. A sheet aligning device as claimed in claim 2, further comprising:

a rivet affixing said axle of said roller to said square so that said roller extends through said aperture.

7. A sheet aligning device as claimed in claim 1, wherein said roller extend beyond said supporting surface by approximately 1 mm.

8. A guide for an aligning station of a package producing machine, comprising:

a surface arranged to abut a trailing edge of a sheet to push and position the sheet along a lengthwise axis of the package producing machine;

a roller mounted so that a peripheral portion of said roller extend before said surface to act as a stop for a trailing edge of the sheet.

* * * * *